United States Patent [19]

Speicher

[11] 4,006,786

[45] Feb. 8, 1977

[54] POWER ACTUATED PORTABLE MARKING TOOL

[75] Inventor: Edwin W. Speicher, Pittsburgh, Pa.

[73] Assignee: M. E. Cunningham Company, Ingomar, Pa.

[22] Filed: July 22, 1975

[21] Appl. No.: 598,116

[52] U.S. Cl. ..... 173/15; 101/3 R; 227/8

[51] Int. Cl.[2] ..... B44B 5/00

[58] Field of Search ..... 101/3, 4; 173/15, 16; 227/7, 8; 60/635, 634, 632, 636, 638

[56] References Cited

UNITED STATES PATENTS

| | | | |
|---|---|---|---|
| 3,554,424 | 1/1971 | Newton | 227/8 |
| 3,762,484 | 10/1973 | Speicher | 173/119 |
| 3,786,977 | 1/1974 | Shamaly | 227/8 |
| 3,915,242 | 10/1975 | Bell | 60/635 X |

FOREIGN PATENTS OR APPLICATIONS

| | | | |
|---|---|---|---|
| 799,442 | 8/1958 | United Kingdom | 173/15 |

*Primary Examiner*—Ernest R. Purser
*Assistant Examiner*—William F. Pate, III
*Attorney, Agent, or Firm*—Stanley J. Price, Jr.

[57] ABSTRACT

A longitudinal housing includes a bore for slidably receiving a barrel assembly having a bore coaxially aligned with the housing bore. A cartridge receiving chamber is positioned within the barrel assembly, and a firing mechanism actuated by a trigger assembly fires the cartridge. The explosion forwardly propels a piston member positioned within the barrel assembly to strike an anvil end portion of a chase. The chase is retained within the bore of a tool holder that is secured to and movable with the barrel assembly. The chase includes a plurality of marker elements for impressing a mark upon the surface of an object. A pair of safety pawls are pivotally connected to the tool holder within the bore thereof and are arranged to contact a sleeve member surrounding the barrel assembly adjacent the forward end portion of the housing to prevent cocking of the firing mechanism unless marker elements are retained within the chase of the tool holder and the elements are depressed against an object to be marked.

10 Claims, 4 Drawing Figures

POWER ACTUATED PORTABLE MARKING TOOL

BACKGROUND OF THE INVENTION

1. Field of the Invention

This invention relates to a portable marking tool and more particularly to a portable marking tool that is actuated by an explosive cartridge.

2. Description of the Prior Art

Portable marking tools for impressing a selective mark on the surface of an object are well known in the art. U.S. Pat. No. 2,455,270 is an example of conventionally known portable marking tools and particularly spring actuated marking tools. A striking spring is compressed behind a hammer which is retained in a locked position within a tubular body portion. Marker elements are secured to an anvil member that is retained within the end portion of the tubular body portion. With the anvil positioned in abutting relation with the surface of the object to be marked, an external force is applied to the body portion moving the body portion to compress the striking spring. Compression of the spring releases the lock mechanism so that the hammer under the compressive force of the spring strikes the anvil, and the force is transmitted through the anvil to the marker elements.

Spring propelled marking tools are limited by the compressive force of the spring in the magnitude of the striking force which can be transmitted to marker elements. To increase the magnitude of the striking force requires a corresponding increase in the size of the spring and the marking tool itself. Consequently, the size of spring actuated marking tools limits the marking force that may be generated. Marking tools having other sources of power are known, such as fluid actuated marking tools as illustrated in U.S. Pat. No. 3,111,997. There pressurized fluid is supplied from a source and directed into a tubular body portion for propelling the hammer. This type of tool requires a pressurized fluid source and a valve connection from the source to the tool.

There is need for a portable marking tool capable of generating striking forces greater than those generated by spring propelled makring tools and more versatile than fluid actuated marking tools.

SUMMARY OF THE INVENTION

In accordance with the present invention, there is provided a power actuated marking tool that includes a longitudinal housing having a forward end portion and a rearward end portion. The longitudinal housing has a bore therethrough. A barrel assembly is positioned within the housing bore for relative movement therein. The barrel assembly includes a bore coaxially aligned with the housing bore. The barrel assembly includes a cartridge receiving chamber positioned within the housing rearward end portion. A tool holder is secured to the barrel assembly adjacent the forward end portion of the housing. The tool holder includes a bore that is coaxially aligned with the barrel bore. A tool support device is positioned for reciprocal movement within the tool holder bore, and retains marking elements in the tool holder. The tool support device includes an anvil end portion axially positioned within the tool holder bore. A piston member is positioned for reciprocal movement within the aligned barrel and tool holder bores and is arranged to abut the forward end portion of the cartridge receiving chamber. A firing mechanism is positioned in the housing rearward of the cartridge receiving chamber. The firing mechanism is operable to actuate forward movement of the piston member in the barrel assembly to strike the anvil end portion and transfer a marking force to the tool support device.

The tool holder includes a tubular connecting member that extends rearwardly of the tool holder and is threadedly secured to the forward end portion of the barrel assembly. The tubular connecting member includes a longitudinal bore that is coaxially aligned with the bores of the tool holder and barrel assembly. The tool support device anvil end portion is spring biased in a forward position within the bore of the tubular connecting member. The tool support device includes a chase extending forwardly of the anvil end portion and slidably movable within the tool holder bore.

The chase retains the marker elements that are used to impress a mark upon an object. A transverse pin member extends through aligned slots of the tool holder and marker elements to secure the chase and marker elements within the tool holder. By depressing the marker elements against a surface to be marked the chase moves rearwardly within the tool holder bore. Rearward movement of the chase urges the tubular connecting member rearward relative to the housing. In this manner, the entire tool holder moves rearwardly. The rearward movement of the tool holder is transmitted to the barrel assembly and provides for cocking of the firing mechanism. In the cocked position the end portion of the piston member abuts the forward end portion of the cartridge receiving chamber, and the rearward end portion of the cartridge receiving chamber abuts the firing pin of the firing mechanism. Actuation of the firing mechanism releases the firing pin to strike the cartridge in the receiving chamber. The explosion of the cartridge drives the piston member forward which strikes the anvil end portion of the chase. The chase is propelled forwardly in the tool holder. The marker elements strike the object to be marked with a substantial force to mark the surface of the object.

The tubular connecting member of the tool support device forms an annulus with the tool holder in the bore thereof. A pair of safety pawls are pinned to the tool holder in the annulus. Each of the pawls has a cam surface that abuts the outer surface of the tubular connecting member and a tapered body portion that extends rearwardly of the tool holder bore. The safety pawls are spring biased in a downward position so that the end portion of the pawls are aligned with a sleeve member that surrounds the barrel assembly at the forward end portion of the housing. In the event a force is exerted upon the end portion of the tool holder, rearward movement of the tool holder and barrel to cock the firing mechanism is restrained by the safety pawls contacting the sleeve member. Engagement of the safety pawls with the sleeve member prevents further rearward movement of the tool holder and barrel assembly. In this manner, undesirable cocking of the firing mechanism and accidental firing of the marking tool is prevented. When the marker elements and chase are depressed within the tool holder bore, however, the pawls are urged to pivot out of alignment with the sleeve member as the cam surfaces rotate on the tubular connecting member. With this arrangement, rearward movement of the tool holder and barrel assembly to cock the firing mechanism is permitted.

Accordingly, the principal object of the present invention is to provide a power actuated portable marking tool that utilizes an explosive cartridge to generate a marking force that is applied to a plurality of marker elements for impressing a mark on the surface of an object to be marked.

A further object of the present invention is to provide a hand operated marking tool that is actuated by an explosive cartridge and includes a tool holder adapted to contain a plurality of selected marker elements for marking the surface of an object with a desired impression.

An additional object of the present invention is to provide a power actuated portable marking tool that includes a safety device that permits actuation of the firing mechanism only when marker elements are retained within a tool holder and an actuating force is exerted upon the marker elements.

These and other objects and advantages of this invention will be more completely described and disclosed in the following specification, the accompanying drawings and the appended claims.

DESCRIPTION OF THE PREFERRED EMBODIMENTS

Figure 1:
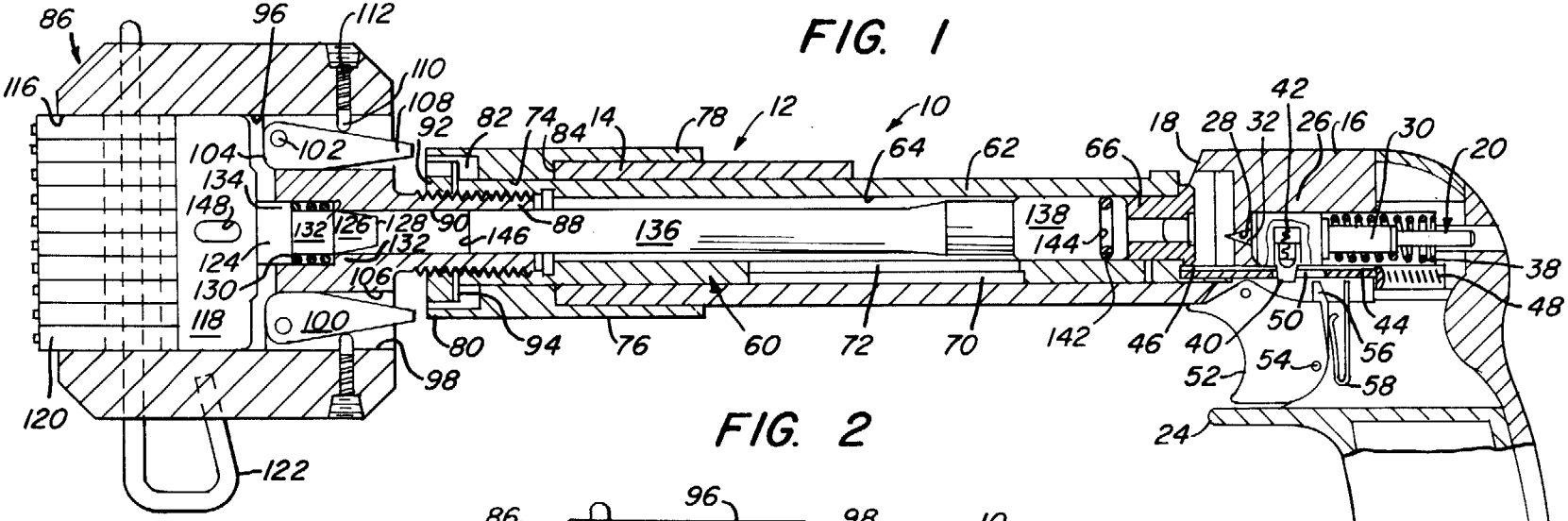
FIG. 1 is a sectional view in side elevation of the power actuated portable marking tool, illustrating the marking tool in an uncocked position.

Referring to the drawings and more particularly to FIG. 1, there is illustrated a portable, power actuated marking tool generally designated by the numeral 10 that includes a housing 12 having a tubular forward portion 14 and a rearward portion 16. The tubular forward portion 14 includes an elongated opening 18 to provide access for loading and unloading an explosive cartridge. The rearward portion 16 and the housing 12 houses the firing mechanism 20 and also includes a pistol grip 22 and a trigger guard 24.

The firing mechanism 20 includes a breech block 26 having a frusto-conical opening 28 therein. A firing pin 30 is mounted behind the breech block 26 for axial movement in the housing 12 and includes a frusto-conical nose portion 32, a body portion 34 and a rearwardly extending rod portion 36. The firing pin 30 is urged forwardly by a suitable spring member 38. A detent member 40 extends radially downwardly from the body portion 34 of the firing pin 30. The detent member 40 is spring biased outwardly by suitable spring means 42.

A cocking rod 44 is mounted for reciprocation in the rearward portion 16 of the housing 12 and includes a forward portion 46 extending through the breech block 26 and into the tubular forward portion 14 of the housing 12. The cocking rod 44 is spring biased forwardly by a spring member 48. The cocking rod also includes an elongated opening 50 through which the detent member 40 on the firing pin 30 extends.

A trigger member 52 is pivotally mounted above the trigger guard 24 by a pivot 54. The trigger member 52 includes a sear portion 56 and is resiliently urged away from the firing position by a spring member 58.

A barrel assembly generally designated by the numeral 60 is reciprocally mounted within the tubular portion 14 of the housing 12. The barrel assembly 60 includes a barrel member 62 having a bore 64 therein, the barrel member 62 also includes a cartridge receiving chamber 66 at its breech end position for receiving an explosive cartridge generally designated by the numeral 68. The bottom outside surface of the barrel member 62 includes an axially extending bottom portion 70 which is planar in a horizontal direction. An elongated slot 72 extends through the bottom portion 70. The barrel assembly 60 also includes an internally threaded end portion 74 of a diameter greater than the bore 64 in the barrel member 62. An elongated sleeve member 76 surrounds the external portion of the barrel member 62 at the threaded end portion thereof and includes a first end portion 78 surrounding the housing 12 and a second end portion 80 that forms an annulus 82 adjacent the threaded end portion 74. A shoulder 84 on the sleeve member 76 abuts the end portion of the housing forward portion 14.

The power actuated portable marking tool 10 includes a tool holder generally designated by the numeral 86 that is connected to the threaded end portion 74 of the barrel member 62 by an externally threaded tubular connecting member 88. The connecting member 88 extends rearwardly of the tool holder 86 into the barrel assembly 60. The tubular connecting member 88 has a bore 90 that is coaxially aligned with the bore 64 of the barrel 62 and the diameter of the bore 90 is less than the diameter of the bore 64. A lock nut 92 and a lock washer 94 are threadedly engaged to the outer surface of the connecting member 88 and are positioned within the annulus 82 of the sleeve member 76 to rigidly secure the connecting member 88 and the tool holder 86 to the barrel assembly 60.

The tool holder 86 has an axial bore 96 therethrough. The tubular connecting member 88 is axially positioned within the bore 96 of the tool holder 86 at the end portion thereof and forms therewith an annulus 98. A pair of safety pawls 100 are pivotally connected to the tool holder 86 within the annulus 98 by pivot pins 102. The safety pawls 100 include a cam surface 104 that abuts outer surface 106 of the connecting member 88. The safety pawls 100 have a tapered body portion that extends rearwardly of the tool holder 86 and terminates in a blunt end portion 108 adjacent the sleeve member 76. The safety pawls 100 are biased in a downward position within the annulus 98 by catch pins 110 and spring members 112 that extend transversely through slots in the end portion of the tool holder 86.

The tool holder 86 has a transverse slotted portion 116 that intersects the bore 96 and is arranged to house a chase 118. Within the chase 118 are secured a plurality of marker elements 120 that are secured in the chase 118 and to the tool holder 86 by a transverse pin 122 that extends through the slots of the tool holder 86 aligned with the slots of the marker elements 120. With this arrangement, the chase 118 and the marker elements 120 are locked to the tool holder 86 within the bore 116 to prevent ejection of the chase 118 from the tool holder 86 in the event the tool 10 is accidentally cocked and fired.

A stem portion 124 of the chase 118 extends rearwardly therefrom and is slidably positioned within the bore of the tubular connecting member 88. The stem portion 124 includes an anvil end portion 126 having a head portion 128 arranged to receive a striking force, in a manner hereinafter explained, to be transmitted through the chase 118 to the marker elements 120. The chase 118 is biased in a forward position by a spring member 130 having a preselected spring force. The spring member 130 is positioned within the enlarged diameter portion of the tubular connecting member 88 between a shoulder 132 of the connecting member 88 and a shoulder 134 of the chase stem 124.

A piston member 136 is reciprocally mounted within the barrel assembly 60 and includes a generally cylindrical head portion 138 and a reduced elongated cylindrical shank portion 140. A piston ring 142 is mounted within a suitable groove 144 about the circumference of the head portion 138 of the piston member 136. The piston member 136 has a striking end portion 146, operable to impart a striking force upon the anvil end portion 128 of the chase 118.

A suitable piston return mechanism (not shown) may be attached to the housing 12 adjacent the forward portion 14 and extend upwardly through the elongated slot 72 in the bottom portion 70 of the barrel member 62. The piston return mechanism is not included within the scope of the present invention; and, therefore, will not be referred to in detail herein. The details of a suitable piston return mechanism are disclosed and described in U.S. Pat. No. 3,497,124. It is a function of the piston return mechanism to return the piston 136 after the power actuated marking tool 10 has been fired to its initial position for the next firing, as illustrated in FIG. 1.

Figure 2:
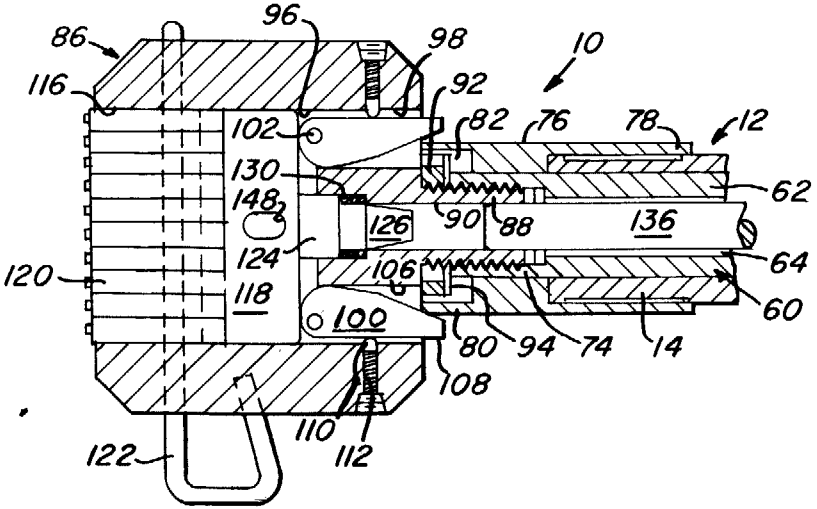
FIG. 2 is an enlarged fragmentary view in section of the power actuated marking tool, illustrated in a cocked position.

In operation, after the selected marker elements 120 have been secured by the transverse pin 122 to the chase 118 and a cartridge 68 is positioned in the cartridge receiving chamber 66, the tool is positioned against the surface of the selected workpiece to be marked. To actuate the portable marking tool 10, the operator must press the marker elements 120 against the work surface to move the chase 118 rearwardly within the bore 96 of the tool holder 86. The chase 118 moves rearwardly within the bore 96 until the rearward face of the chase abuts the forward portion of the safety pawls 100. With this arrangement, continued depressing of the marker elements 120 against the work surface urges the chase 118 to pivot the safety pawls 100 about the pins 102 as the cam surfaces 104 ride against the outer surface 106 of the tubular connecting member 88. The end portions 108 of the safety pawls 100 move laterally beyond the sleeve member 76 as illustrated in FIG. 2, to permit further rearward movement of the chase 118.

The rearward movement of the chase 118 compresses the spring member 130 and is transmitted to the tubular connecting member 88 and therefrom to the barrel member 62 threadedly secured to the connecting member 88. Rearward movement of the barrel member 62 relative to the housing 12 urges the barrel assembly 60 against the cocking rod 44 which abuts the rearward end portion of the barrel member 62. By virtue of the detent member 40 extending into the opening 50 of the cocking rod 44, the housing 12 moves forwardly with respect to the firing pin 30 until the forward face of the breech block 26 abuts the rear surface of the barrel assembly 60.

The detent member 40 of the firing pin 30 is aligned with the sear portion 56 of the trigger member 52 when the forward face of the breech block 26 abuts the rear surface of the barrel assembly 60. By pulling the trigger member 52, the sear portion 56 releases the detent member 40 from the opening 50, and the cocking rod and the firing pin 30 move forwardly by the action of the spring member 38 until the nose portion 32 ejects through the frusto-conical opening 28 in the breech block 26. In this manner, the explosive cartridge 68 is actuated.

Figure 4:
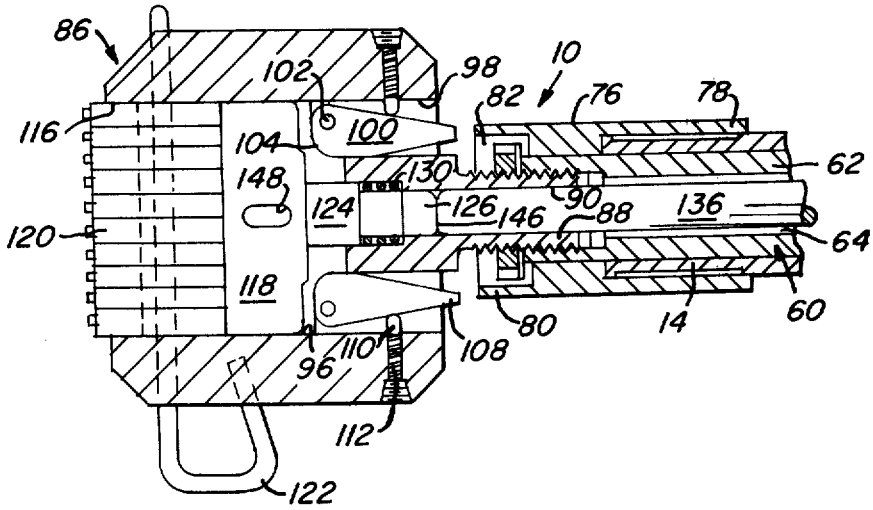
FIG. 4 is a view similar to FIG. 3, illustrating the power actuated marking tool in a fired position.

The gases generated by the explosion of the cartridge 68 drive the piston member 136 forwardly to impart a striking force by the striking end portion 146 upon the anvil end portion 126. The striking force is transmitted through the anvil end portion 126 to the chase 118 and the markers 120 in the manner illustrated in FIG. 4. The chase and markers move within the head portion bore 90 and thereby transmit the striking force to the object to be marked with the desired velocity and force to impress a mark upon the object.

Figure 3:
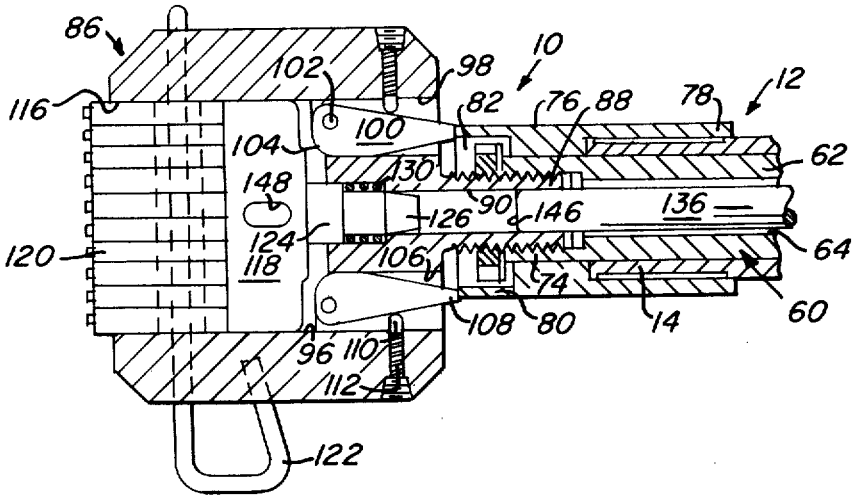
FIG. 3 is a view similar to FIG. 2, illustrating the power actuated marking tool in a safe position.

As illustrated in FIG. 3, the safety pawls 100 are arranged within the tool holder 86 to prevent rearward movement thereof. The safety pawls 100 prevent cocking of the marking tool 10 when a rearward force is applied to the forward face to the tool holder 86 without applying a rearward force to the marking elements 120 secured to the chase 118. With this arrangement, if the marker elements 120 are not positioned in the chase 118 and a cartridge 68 is positioned within the cartridge receiving chamber 66, the portable marking tool can not be actuated and accidentally fired. This feature prevents firing of the marking tool 10 and propelling of the chase member 118 from the tool holder 86. In addition, the chase 118 is provided with a longitudinal slot 148 that is arranged to receive a retaining pin (not shown) extending through the body portion of the tool holder 86 into the slot 148. With this arrangement, longitudinal movement of the chase 118 relative to the head portion 86 is limited.

In the event a rearward depressing force is applied upon the forward face of the head portion 86 alone, the safety pawls 100 remain in a downward position by the force of the spring members 112 against the catch pin 110. Thus, when the tool portion 86 moves rearwardly to the point where the end portion 108 of the safety pawls 100 contacts the forward end portion of the sleeve member 76, further rearward movement of the tool holder 86 is restrained. Also, the retaining pin within the slot 148 serves to prevent rearward movement of the tool holder 86. Restraining rearward movement of the tool holder 86, in turn, restrains rearward movement of the barrel assembly 60 and prevents actuation of the firing mechanism 20. In this manner, accidental firing and propelling of the piston 136 to strike the anvil end portion 126 and forward propelling of the chase 118 out of the tool holder 86 is prevented.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A power actuated marking tool comprising, a longitudinal housing having a forward end portion and a rearward end portion, said longitudinal housing having a bore therethrough, a barrel assembly positioned within said housing bore for relative movement therein, said barrel assembly having a bore coaxially aligned with said housing bore, said barrel assembly having a cartridge receiving chamber positioned within said housing rearward end portion, a tool holder secured to said barrel assembly adjacent said forward end portion of said housing, said tool holder having a bore therethrough coaxially aligned with said barrel assembly bore, tool support means positioned for reciprocal movement within said tool holder bore for retaining marking elements in said tool holder, said tool support means having an anvil end portion axially positioned within said tool holder bore, a piston member positioned for reciprocal movement within said aligned barrel and tool holder bores and arranged to abut the forward end portion of said cartridge receiving chamber, firing means positioned in said housing rearward of said cartridge receiving chamber for actuating forward movement of said piston member in said barrel assembly to strike said anvil end portion and transfer a marking force to said tool support means, safety means pivotally connected to said tool holder within said bore thereof for restraining rearward movement of said tool holder and barrel to prevent cocking of said firing means when in a first position, and said safety means operable to assume a second position relative to said tool holder to permit rearward movement of said tool holder and barrel to permit cocking of said firing means.

2. A power actuated marking tool as set forth in claim 1 which includes, said safety means being operable in said first position to prevent rearward movement of said tool holder and cocking of said firing means when an actuating force is applied to said tool holder, and said safety means being operable in said second position to permit rearward movement of said tool holder and cocking of said firing means when an actuating force is applied to said tool support means.

3. A power actuated marking tool as set forth in claim 2 in which said safety means includes, a sleeve member surrounding said barrel assembly at said housing forward end portion, a pair of pawls pivotally secured within said tool holder bore and having end portions extending to a position adjacent said housing forward end portion, spring means for maintaining said pawl end portions aligned with said sleeve member to prevent rearward movement of said tool holder when said pawl end portions abut said sleeve member, and said pawl end portions arranged to pivot out of alignment with said sleeve member upon rearward movement of said tool support means within said tool holder to permit rearward movement of said tool holder and cocking of said firing means.

4. A power actuated marking tool as set forth in claim 3 which includes, said tool support means arranged upon the application of an actuating force thereto to move rearwardly within said tool holder bore and contact said pair of safety pawls to urge said safety pawls to pivot out of alignment with said sleeve member so that further rearward movement of said tool support means actuates cocking of said firing mechanism.

5. A power actuated marking tool as set forth in claim 3 which includes, said safety pawls having cam surfaces abutting said tool holder within said bore thereof, said spring means operable to maintain said safety pawl cam surfaces in abutting relation with said tool holder, and said tool support means arranged to contact and pivot said safety pawls within said tool holder bore so that said cam surfaces move relative to said tool holder and overcome the force of said spring means to pivot said safety pawls out of alignment with said sleeve member.

6. A power actuated marking tool as set forth in claim 5 which includes, said safety pawls arranged to contact said sleeve member and prevent rearward movement of said tool holder and barrel assembly when an actuating force is applied to said tool holder.

7. A power actuated marking tool as set forth in claim 1 in which said tool holder includes, a tubular connecting member having a bore coaxially aligned with said tool holder bore and positioned within said barrel assembly bore, means for securing said tubular connecting member to said barrel assembly, and said tool support means arranged to contact the forward end portion of said tubular connecting member and thereby axially move said tool holder and barrel assembly rearwardly within said housing to cock said firing mechanism when an actuating force is applied to said tool support means.

8. A power actuated marking tool as set forth in claim 7 which includes, said tool support means movably positioned within said tubular connecting member bore, resilient means surrounding said tool support means within said tubular connecting member bore for maintaining said tool support means in a forward position within said tool holder bore, and said resilient means arranged to return said tool support means to a forward position within said tool holder bore after actuation of said firing mechanism.

9. A power actuated marking tool as set forth in claim 1 in which said tool support means includes, a chase member positioned for reciprocating longitudinal movement within said tool holder bore and having a stem portion coaxially positioned in said tool holder bore and aligned with said barrel assembly bore, said chase member having pin means for receiving marker elements thereto, said anvil end portion extending rearwardly of said stem portion, and said anvil end portion arranged to receive a striking force from said piston member for transfer through said chase member to the marker elements being secured thereto.

10. A power actuated marking tool as set forth in claim 1 which includes, said tool holder having a transverse slotted portion intersecting said bore, and pin means extending through said tool holder slotted portion and said tool support means within said tool holder for securing marker elements supported by said tool support means within said tool holder bore.

* * * * *